US006180172B1

(12) United States Patent
Hasenkamp et al.

(10) Patent No.: US 6,180,172 B1
(45) **Date of Patent: *Jan. 30, 2001**

(54) PROCESS AND APPARATUS FOR TREATING SURFACES

(75) Inventors: Rainer Hasenkamp; Wigand Staehlin, both of Bopfingen (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/849,262

(22) PCT Filed: Nov. 24, 1994

(86) PCT No.: PCT/EP95/04642

§ 371 Date: Aug. 25, 1997

§ 102(e) Date: Aug. 25, 1997

(87) PCT Pub. No.: WO96/16777

PCT Pub. Date: Jun. 6, 1996

(30) Foreign Application Priority Data

Nov. 29, 1994 (DE) ..... 44 42 397

(51) Int. Cl.[7] ..... B05D 7/06; B05D 1/28; B05C 1/14

(52) U.S. Cl. ..... 427/277; 427/278; 427/284; 427/359; 427/369; 427/370; 427/428; 118/106; 118/257; 428/425.1; 428/479.6; 428/481

(58) Field of Search ..... 427/146, 278, 427/284, 277, 317, 370, 393, 397, 359, 428; 428/192, 537.1, 425.1, 479.6, 481; 118/106, 257, 410

(56) References Cited

U.S. PATENT DOCUMENTS

| | | | | |
|---|---|---|---|---|
| 3,093,071 | * | 6/1963 | Taylor . | |
| 3,219,473 | * | 11/1965 | Dimond et al. . | |
| 3,967,581 | * | 7/1976 | Zirbel . | |
| 4,070,987 | * | 1/1978 | Gross et al. . | |
| 4,417,406 | * | 11/1983 | Eibich | 34/155 |
| 4,828,779 | * | 5/1989 | Hiraki et al. . | |
| 5,085,841 | * | 2/1992 | Evans . | |
| 5,085,891 | * | 2/1992 | Evans | 427/277 |
| 5,124,210 | * | 6/1992 | Fong . | |
| 5,130,184 | * | 7/1992 | Ellis . | |
| 5,308,657 | * | 5/1994 | Markusch . | |
| 5,487,780 | * | 1/1996 | Ritter . | |
| 5,733,596 | * | 3/1998 | Arrington . | |

FOREIGN PATENT DOCUMENTS

| | | | |
|---|---|---|---|
| 4305081 | * | 8/1994 | (DE) . |
| 745057 | * | 2/1956 | (GB) . |
| 745 057 | | 2/1956 | (GB) . |
| 89/09656 | * | 10/1989 | (WO) . |

* cited by examiner

*Primary Examiner*—Fred J. Parker
(74) *Attorney, Agent, or Firm*—Wayne C. Jaeschke; Stephen D. Harper; Daniel S. Ortiz

(57) ABSTRACT

A process and apparatus for edge coating a substrate is provided. A process provides a layer of a formable coating material on a transfer belt which layer of formable material has a variable thickness over the width of the layer, applying a layer of the formable coating material on the transfer belt to the edge surface to produce a coated edge surface and smoothing the coated edge surface by contact with a smoothing belt. The coating on the edge surface is sufficiently thick to cover and smooth irregularities in the edge surface of the substrate. The coated edge surface can be further treated by the usual methods for coating edge surfaces of flat substrates. The apparatus comprises the roller or nozzle to provide the layer of formable material of variable thickness on the transfer belt, the transfer belt carries the coating material to the edge surface and the transfer belt can act as a smoothing belt to provide an edge surface with the coating material with all of the irregularities obscured.

64 Claims, 1 Drawing Sheet

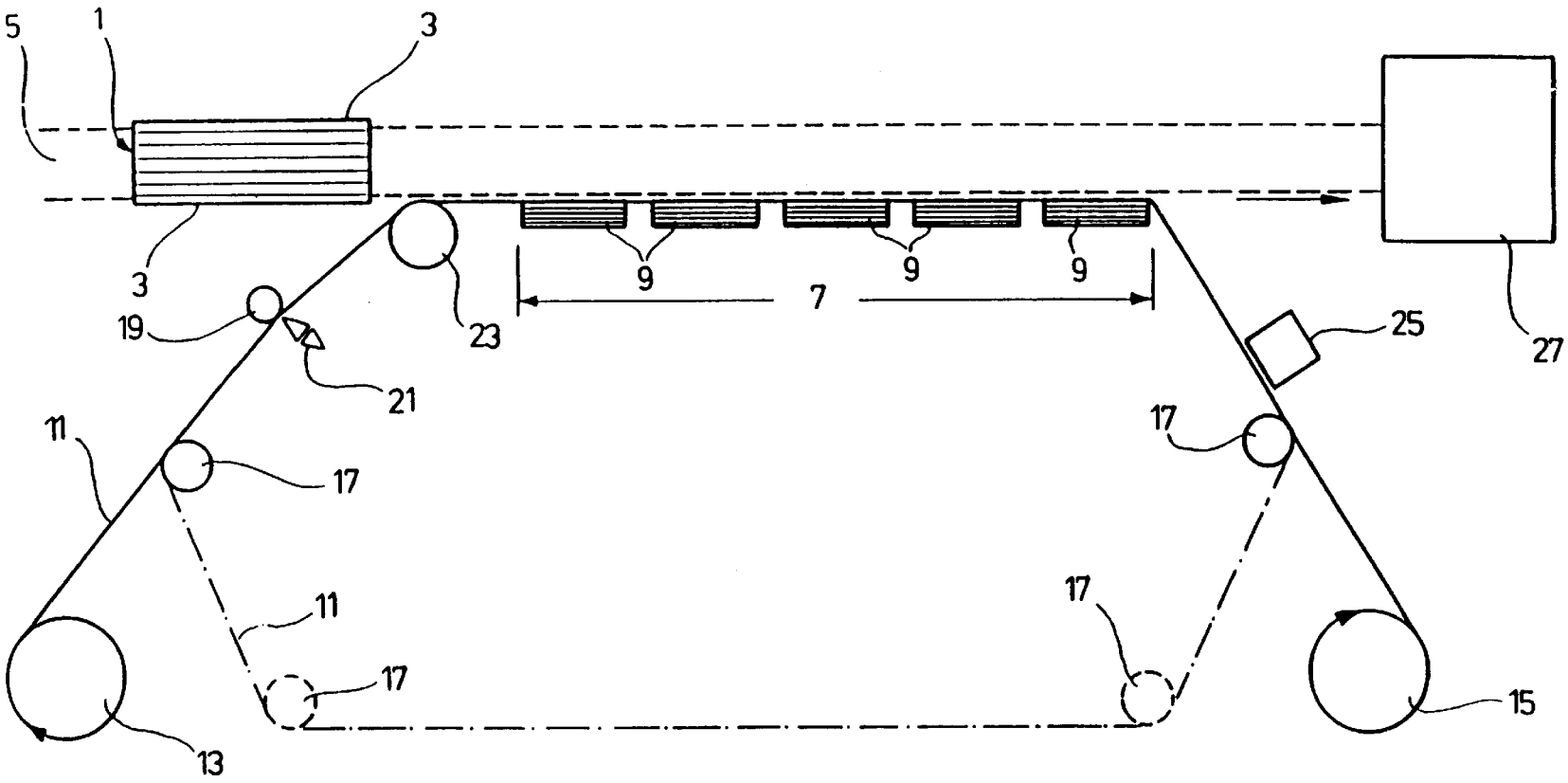
27
25
3
1
5
3
9
9
9
7
23
21
19
17
17
17
11
11
15
13

PROCESS AND APPARATUS FOR TREATING SURFACES

DESCRIPTION

This invention relates to a process and an arrangement for treating surfaces.

BACKGROUND OF THE INVENTION

Surface treatment processes are widely used in the furniture industry in particular. The wooden materials used in that industry are not normally left in their original state, but receive a refining surface coating, generally a melamine coating. Veneers, decorative laminates or decorative films are also used as coating materials.

The coating of side faces, edges or, generally, narrow surfaces often involves the use of a special edging material, for example an edge veneer or a so-called narrow-surface band which is applied to the narrow surfaces with an adhesive. This process is generally known as edge banding.

However, it is often desirable to round off the narrow surfaces or edges for aesthetic reasons or to provide profiled surfaces for functional reasons. Besides the edge banding process mentioned above, which is also known as soft-forming, other processes are used to coat the "soft" contours in question.

One way of carrying out surface coating is to use the coating material on top and underneath as the edging material. In a first step, the coating material is applied to the upper and lower surfaces of a board to be coated, preferably using a dispersion adhesive. A sufficient excess length of the coating material is generally left in the vicinity of the edge to be coated and is suitably flexibilized, normally by heating. The flexibilized excess length is then bent around the edge to be coated and secured with a dispersion or hotmelt adhesive. This process is also known as post-forming.

In a modification of the post-forming process described above, the excess length of coating material is obtained by free milling, the material situated below the required excess length being removed. This process is known as direct post-forming.

However, one aspect common to all these processes is that they use a solid coating material which is difficult to handle and also expensive, not least because of non-reusable cutting waste.

In addition, the surfaces to be coated are often extremely uneven with voids, etc. This applies in particular to chipboards.

Surfaces in this condition coated by one of the processes mentioned above lead to a very uneven, "bumpy", wavy material surface which spoils the appearance of, for example, the subsequent piece of furniture. To produce an improvement, thicker edging or coating materials are often used. They are capable of satisfactorily levelling out the surface unevenness and of preventing the surface substrate from showing through (telegraphing). Unfortunately, any increase in the thickness of the coating material is accompanied by an increase in the stiffness of the bent coating material. This in turn leads to an increased press-on length for gluing the stiffer coating material. Moreover, stiffer coating materials are generally more expensive.

These disadvantages cannot be eliminated in the described post-forming processes either.

Accordingly, the problem addressed by the present invention was to provide a process and an arrangement with which the disadvantages mentioned above could be eliminated and a surface smoothing treatment could readily be carried out.

BRIEF DESCRIPTION OF THE SEVERAL VIEWS OF THE DRAWING

FIG. 1 shows an embodiment of the apparatus of the invention.

DETAILED DESCRIPTION OF THE INVENTION

This problem has been solved by a process comprising the steps defined in process claims and, in addition, by an arrangement having the features of the apparatus.

By virtue of the fact that a formable, non-solid coating material is used, coating can be simplified in contrast to the processes mentioned above, for example the turning down of an excess length of material. The required smoothing of the coating material applied is obtained by a smoothing belt which, compared with rollers or slide blocks, is easy to use and hence inexpensive. The surface thus coated is ready for further coating. However, by virtue of its high quality, it can also be left as such.

The coating material is preferably applied to the surface with the aid of a transfer belt. This has the advantage that there is no need for an application roller adapted to the profile of the surface to be coated for applying the material. In view above all of the large number of different edge profiles, the production of such application rollers adapted to the profiles or even specially adapted application nozzles is time-consuming and extremely expensive. Moreover, different profiles cannot be coated in a short time. The transfer belt is preferably also used as a smoothing belt so that there is no need for smoothing rollers or smoothing slide blocks. This results in a further saving.

The coating material is preferably applied to the surface to be treated by pressure. A suitable pressure applicator applies pressure to the uncoated side of the belt so that the coated side of the transfer belt is pressed onto the surface to be coated.

An improvement in the application of the coating material is obtained by an additional heat treatment. Infra-red heaters, hot air blowers, high-frequency heaters or the like are preferably used for this purpose.

In one preferred embodiment of the process and the arrangement according to the invention, the coating material is applied to the transfer belt immediately before application to the surface to be coated. This is preferably done by means of a suitable application roller or an application nozzle which applies the material to the transfer belt in an adjustable thickness. When determining the thickness of the material, it is of advantage to increase it in the middle part of the transfer belt. As already mentioned, unevenness is at its greatest in this particular region of the surface to be coated so that it follows that more material has to be used there.

In another advantageous embodiment of the invention, the transfer belt is removed from the surface to be treated, the material having penetrated into and solidified in the pores of the surface to be treated so that it does not stick to the transfer belt during its separation.

Another advantageous embodiment of the invention is characterized in that, after separation the transfer belt is returned to the application roller so that an endless belt may be used.

Thermoplastic materials have proved to be particularly advantageous for coating. On the one hand, they combine well with the surface and, on the other hand, they are readily formable and smoothable.

Other advantageous embodiments are defined in the claims below.

BRIEF DESCRIPTION OF THE DRAWINGS

Several examples of embodiment of the invention are described in detail in the following with reference to the accompanying drawing. The sole FIGURE schematically illustrates a transfer coating arrangement with reference to which the process according to the invention is also described.

EXAMPLES

A wooden board to be coated, i.e. a chipboard 1 with two profiled narrow surfaces 3, lies on a conveyor belt 5. The conveyor belt 5 is driven by suitable drive units (not shown) and carries the chipboard 1 in the arrowed direction, i.e. from left to right in the drawing. Several pressure applicators 9 spaced at intervals from one another are arranged along the conveyor belt 5 in a pressure zone 7.

The pressure applicators are preferably pressure pads and/or slide blocks 9. However, pressure rollers or a combination of pressure rollers and slide blocks 9 can also be used.

A transfer belt 11 is offwound from a roll 13 (supply roll) and, after passing through the pressure zone 7 between the conveyor belt 5 or rather the chipboard 1 and the pressure applicator 9, is rewound by another roll 15. The drive system for transporting the transfer belt 11 normally co-operates with the other roll 15.

Since the speed at which the transfer belt is transported preferably corresponds to the speed at which the chipboard 1 is transported, the speed at which the other roll 15 is driven is adjusted in dependence upon the wound diameter.

The control mechanism for the other roll 15 can be omitted if an endless transfer belt 11 (shown as a dash-dot line in the FIGURE) is used instead of the transfer belt offwound from the roll 13. In this case, the two rolls 13 and 15 would be replaced by various guide rolls 17 which would return the transfer belt 11 to the beginning after it had passed through the pressure zone 7. The endless transfer belt 11 is drawn along by the boards 1 to be coated; a separate drive may also be provided.

An application nozzle or an application roller 19 is arranged ahead of the pressure zone 7 (in the transport direction) on the transport path of the transfer belt 11. Positioned opposite the nozzle or roller 19 is a press-on element 21, the transfer 11 belt being guided through between these two parts. It is not shown in the FIGURE that the application roller 19 is supplied by suitable means with a coating material, for example a thermoplastic material. The application roller 19 has a surface suitable for the application of fluid material which is optionally formed with indentations, grooves or the like in order to vary the thickness in which the material is applied over the width of the roller or rather the transfer belt. If an application nozzle is used, the slit is made correspondingly wider or narrower in order similarly to achieve a thickness of the material variable over the width.

Provided between the application roller 19 and the pressure zone 7 is a fixing roller 23 which brings the transfer belt 11 into its first adhesive contact with the narrow surface 3 to be coated.

Provided along the transport path of the transfer belt 11 is a cleaning element 25 which removes any soil adhering to the transfer belt 11. Adhering soil could prevent clean application of the material by the application roller 19.

A finishing section 27 where, for example, the edges are sanded or the actual soft-forming or post-forming process is carried out is schematized at the end of the conveyor belt 5 in the drawing.

The transfer coating process is described in more detail in the following with reference to the arrangement described above:

The preferably fluid thermoplastic material to be applied is applied by the application roller 19 to one side of the transfer belt 11. Since the chipboards 1 to be coated are individually transported on the conveyor belt 5, the application roller 19 preferably operates at intervals. It begins applying the thermoplastic material when the chipboard 1 to be coated still has a distance to travel to the fixing roller 23 which corresponds to the distance the transfer belt 11 travels to reach the fixing roller 23. Accordingly, the beginning of the section of transfer belt wetted with material coincides with the front edge of the chipboard at the fixing roller 23. The length of the wetted section of transfer belt corresponds to the edge length of the narrow surface 3. This interval control is very easy to achieve through suitable sensors, for example light beam guards positioned at suitable locations.

During application of the thermoplastic material, the press-on element 21 ensures that the transfer belt does not yield or give way to the pressure of the application roller. Accordingly, it acts as a support.

The fixing roller 23 then brings the coated transfer belt 11 into contact with the narrow surface 3 so that the position of the transfer belt 11 on the narrow surface 3 is fixed for the first time.

As the chipboard 1 enters the pressure zone 7, the transfer belt 11 is preferably first pressed with a certain, adjustable force onto that section of the narrow surface 3 which is situated nearest the pressure pad or slide block. The contact pressure applied must be high enough to ensure that the thermoplastic material thoroughly penetrates into the pores of the narrow surface 3. The other pressure pads or slide blocks following the first pressure pad or slide block 9 are positioned in such a way that, up to the end of the pressure zone 7, the other sections of the narrow surface 3 are also subjected to a contact pressure. The pressure pads or slide blocks are preferably adapted to the contour of the narrow surface 3.

Pressure pads or slide blocks 9 are shown purely schematically in the drawing. However, pressure rollers may also be used in the pressure zone either on their own or in combination with pressure pads or slide blocks. The exact arrangement of the individual pressure elements is known to the average expert so that there is no need for a detailed explanation here.

The length of the pressure zone 7 or the speed at which the chipboard 5 is transported by the conveyor belt 1 has to be gauged in such a way that the thermoplastic material applied to the narrow surface 3 has hardened by the time it leaves the pressure zone 7 in order to achieve firm anchorage of the thermoplastic material in the narrow surface.

The transfer belt 11 is then separated from the chipboard 1 after the pressure zone 7.

The chipboard 1 with the coated narrow surface 3 is then transported into the finishing section 27 in which the actual edge banding process is carried out by soft-forming or post-forming. Since the thermoplastic material levels out the unevenness originally present in the narrow surface 3 and forms a very smooth surface, satisfactory smooth final coating of the narrow surface 3 is possible by the known methods mentioned.

The effect of the pressure pads or slide blocks 9 in the pressure zone 7 can be enhanced by the additional application of heat, for example by infra-red heaters, high-frequency heaters or hot air blowers. The relatively high temperature improves the fluidity of the thermoplastic material so that it is able to penetrate better and more deeply into the pores of the narrow surface 3. When or even before the fixing roller 23 is reached, the narrow surface 3 of the chipboard 1 to be coated may also be heated, for example by infra-red radiation, so that the effect just mentioned can be further enhanced.

The thermoplastic material itself must be of such a character that it does not soften or lose its strength at the usual service temperatures for furniture which are normally between −10° C. and 100° C. The softening point of the thermoplastic material is preferably so high that the heat of friction generated during machine smoothing or machine polishing does not lead to unwanted softening (plasticization) of the thermoplastic material. In that event, the relatively soft thermoplastic material would soil the abrasive belts relatively quickly and would thus render them prematurely unusable. In addition, the heated hotmelt adhesive applied, for example, in the subsequent soft-forming or post-forming process should not lead to a high degree of softening and hence possibly to unwanted deformation of the thermoplastic material applied during the pretreatment of the narrow surfaces.

In order to be able to use commercially available holtmelt dispensers for applying the thermoplastic material to the transfer belt 11, the thermoplastic material should be sufficiently fluid at temperatures of 150 to 250° C. and preferably at temperatures of 180 to 230° C. Free flow of the material is important insofar as the material is thus better able to wet the transfer belt, can be better applied to the narrow surface 3 to be coated and, in addition, is better able to penetrate into the pores of the chipboard. In order to avoid excessive penetration, that side of the coating or the conveyor belt which is remote from the narrow side is cooled, for example by means of a cold air shower or a cooling roller. Accordingly, that part of the coating material which is in contact with the conveyor belt hardens very quickly so that less "sinks" into the surface.

By selecting a material which solidifies relatively quickly, the necessary residence time of the chipboard 1 in the pressure zone 7 can be shortened. In addition, the transfer belt 11 is easier to separate from a completely solidified material.

In addition, the thermoplastic material should be "adhesion-friendly", i.e. the thermoplastic material should have a high affinity for the adhesive applied at a later stage. Preferred thermoplastic materials are ethylene/vinyl acetate copolymers (EVA), polyamides, polyesters, so-called polyolefins (atactic poly-α-olefins) and thermoplastic polyurethanes (TPUs) either individually or as compounds (mixtures), EVA and polyesters being used solely as compounds in admixture with other substances. Besides two-component systems based on epoxy/amine or UV-crosslinking systems based on acrylate, methacrylate or unsaturated polyesters, reactive thermoplastics, such as isocyanate-terminated PUR prepolymer for example, may also be used as thermosets.

Other suitable coating materials are mineral surfacing compounds which are applied wet and which cure in a short time. For example, there are cement-containing powders, gypsum and gypsum-related powders which cure very quickly after mixing with water. Inorganic powders such as these may also be mixed with dispersion-containing mixing liquids for the purpose of elasticization. For continuous application, such powders may be mixed with the water-containing mixing liquid, for example in a screw extruder, and applied immediately afterwards to the transfer belt, the mixing and application time having to be within the setting time of the transfer compound. To accelerate hardening, particularly of the uppermost layer facing the transfer belt, heat may also be applied to the pressure zone, for example by means of heated pressure rolls or pressure pads.

Other coating materials may of course also be used.

The transfer belt serving as carrier for the coating material must be flexible enough to follow closely the contour of the narrow surface 3 under the pressure applied by the pressure pads 9 or pressure rollers. The transfer belt 11 must also be heat-resistant so that it is not permanently deformed at the high temperatures at which the thermoplastic material is applied. Moreover, it should be unaffected by a rapid sequence of heating and cooling such as occurs in particular where the belt is used in the form of an endless belt.

Polypropylene, polyester and silicone, for example, have proved to be particularly good materials although certain commercially available paper-based thermoset edge bands are equally suitable. All these materials have a sufficiently low affinity for the thermoplastic material for the transfer belt to be readily removable from the pretreated chipboard.

As mentioned above, the thermoplastic material must have a high affinity for a hotmelt adhesive applied at a later stage so that the two materials are firmly united. An improvement in this adhesive bond can be obtained by heating the thermoplastic material applied to the narrow surface 3, for example by infra-red radiation or by a hot air shower, before application of the edge band or before or during bending of the excess length of coating material in the post-forming process. Heating results in liquefaction/plasticization of the at least uppermost layer of the thermoplastic material so that melting of the uppermost layer of the thermoplastic material is promoted by the hotmelt adhesive applied to the edge material and results in better adhesion of the edge material. However, it is important in this regard to ensure that the thermoplastic material is not overly liquefied and deformed.

Through the above-described heating of the at least uppermost layer of the thermoplastic material and its liquefaction, this material may serve as a replacement for the adhesive applied to the edge band. In other words, the thermoplastic material may also be used as an adhesive. However, this does presuppose that the narrow surface or at least all those areas of the narrow surface which are crucial to effective bonding is/are completely covered with the thermoplastic material and that the edge material has little stiffness and resilience.

As for the rest, the quality of the thermoplastic material applied to the narrow surface 3 may be selected so that a correspondingly pretreated or coated narrow surface may be lacquered or coated with a hot embossing film without any further treatment.

Finally, it has been found that a fusible plastic may also be used as a substitute for the thermoplastic material. This fusible plastic hardens physically after coating in the same way as a normal thermoplastic, but is then chemically crosslinked to form a thermoset, for example under the effect of heat or moisture. Fusible crosslinking plastics of the type in question are known, for example, as reactive polyurethane-based hotmelt adhesives. The fully reacted hardened coating material is heat-, water- and impact-resistant and stable to chemicals.

Pigments may also be added to the coating material so that a ready-to-use edge can be obtained in the required color. The crosslinked coating material may of course also be lacquered although it is imperative to use a lacquer system of which the solvent does not swell or even dissolve the as yet unhardened coating material. A water-based lacquer system is thus preferred.

If the coating material is intended to have a visually attractive structure, for example a wood vein structure, after hardening, the as yet uncrosslinked coating material may be treated with embossing rollers. However, the embossing rollers must have a surface so that they separate readily from, and do not damage, the coating material.

Besides the coating process described above, it is also possible directly to apply the coating material to the surface by suitable application means, for example in the form of an application roller or an application nozzle, and then to smooth it by means of a circulating smoothing belt. If, in addition, a particularly large amount of material is to be applied, the two processes may also be combined with one another, in which case an applicator initially applies a first quantity of material and the transfer belt described above applies the second quantity of material. The transfer belt is again responsible for smoothing.

The described coating process is particularly suitable for wooden materials, such as solid wood, chipboards or MDF (medium-density fiberboards). However, plastics and metals may also be coated by the described process.

Apart from smoothing surfaces, the coating material also affords protection against mechanical stressing. For example, metal rails along the edges of concrete formwork boards can be replaced by a coating of a material which cures to form a thermoset. Other applications are of course also possible.

Thus, a strip of a colored decorative resin-impregnated paper may be laminated under pressure and heat onto the smoothed narrow surface of a wooden board, particularly a chipboard, so that the resin deliquesces and cures to form an irreversible thermoset. The impregnating resin may consist, for example, of a pure melamine resin or melamine/urea resin blends. Papers thus impregnated are used in the chipboard industry for directly coating wooden boards in various presses (multi-daylight, short-cycle, continuous presses). If the same resin-impregnated paper is used both to coat the upper and lower surfaces (broad surfaces) and to laminate the smoothed narrow surface of the wooden board, the workpieces obtained have the same thermoset surface material all round on all surfaces.

What is claimed is:

1. A process for treating an edge surface comprising a narrow surface between two non-intersecting surfaces of a wooden substrate to produce a smoothed, textured or embossed coating thereon comprising the steps of:

a) applying a layer of a formable coating material on a transfer belt, the layer of the formable coating material conforming to a length of the edge, being continuous and having a variable thickness over the width of the layer;

b) contacting and transferring the layer of the formable coating material on the transfer belt to the edge surface to produce a coated edge surface; and c) contacting the coated edge surface with a belt whereby the surface is smoothed.

2. The process as claimed in claim 1, wherein the coating material is a thermoplastic material.

3. The process as claimed in claim 2, wherein the thermoplastic material has a softening point above the usual service temperature of the surface.

4. The process as claimed in claim 2, wherein the thermoplastic material has a softening point above about 100° C.

5. The process as claimed in claim 2, wherein the thermoplastic material is fluid in a temperature range of about 150° C. to about 250° C.

6. The process as claimed in claim 2, wherein the thermoplastic material is fluid in a temperature range of about 180° C. to about 230° C.

7. The process as claimed in claim 2, wherein the thermoplastic material has an affinity for adhesive.

8. The process as claimed in claim 1, wherein the coating material is a thermoplastic material selected from the group consisting of ethylene/vinyl acetate copolymers, polyamides, polyesters, polyolefins, thermoplastic polyurethanes and mixtures thereof.

9. The process as claimed in claim 8, wherein the polyolefin is substantially atactic poly-α-olefin.

10. The process as claimed in claim 1, wherein the coating material is a crosslinkable thermoplastic.

11. The process as claimed in claim 10, wherein the coating material is a crosslinkable thermoplastic selected from the group consisting of a moisture-crosslinking isocyanate-terminated polyurethane prepolymer, a two-component system based on epoxylamine, a UV-crosslinking system based on acrylate wherein the reactive thermoplastic crosslinks to form a thermoset, a UV-crosslinking system based on methacrylate wherein the reactive thermoplastic crosslinks to form a thermoset, a crosslinking system based on unsaturated polyester wherein the reactive thermoplastic crosslinks to form a thermoset and mixtures thereof.

12. The process as claimed in claim 10, wherein the coating material is a crosslinkable polyurethane-based hot-melt adhesive, wherein said thermoplastic first sets after cooling and is then chemically crosslinked to form a thermoset.

13. The process as claimed in claim 1, wherein the coating material is a mineral surfacing compound.

14. The process as claimed in claim 1, wherein the transfer belt is an endless belt.

15. The process as claimed in claim 1, wherein the transfer belt is a flexible belt.

16. The process as claimed in claim 1, wherein the side of the transfer belt proximal to the edge surface is wetted with a thermoplastic material.

17. The process as claimed in claim 1, wherein the transfer belt comprises a material selected from the group consisting of polypropylene, polyester, silicone and combinations thereof.

18. The process as claimed in claim 1, wherein the transfer belt also comprises the belt whereby the surface is smoothed.

19. The process as claimed in claim 1, further comprising the step of heating the coating material, wherein said heating occurs during applying the layer of the coating material on the transfer belt.

20. The process as claimed in claim 1, wherein said contacting and transferring step further comprises applying pressure to the side of the transfer belt distal from the surface, whereby said pressure on said transfer belt effects the transfer of said coating to said edge surface.

21. The process as claimed in claim 1, further comprising the step of applying the layer of coating material on the transfer belt by means of an application nozzle.

22. The process as claimed in claim 1, further comprising the step of applying the layer of coating material on the transfer belt by means of an application roller.

23. The process as claimed in claim 1, further comprising the step of heating the coating material, wherein said heating occurs during the application of the layer of coating material to the edge surface.

24. The process as claimed in claim 1, further comprising the step of heating the coating material, wherein said heating occurs after the contact and transferring of the layer of coating material to the edge surface.

25. The process as claimed in claim 1, further comprising the step of cooling the transfer belt on that side distal from the edge surface.

26. The process as claimed in claim 1, further comprising the step of separating the transfer belt from the coated edge surface after contact and transfer of the coating to the edge surface.

27. The coated surface produced by the process of claim 1.

28. A process for treating an edge surface to produce a smoothed, textured or embossed coating thereon comprising the steps of:

applying a layer of a formable coating material by means of an application roller to an edge surface comprising a narrow surface between two non-intersecting surfaces of a wooden substrate to produce a coated edge surface having a continuous coating with a variable thickness over the width of the layer, and contacting the coated edge surface with a belt whereby the surface is smoothed.

29. The process as claimed in claim 28, wherein the coating material is a thermoplastic material.

30. The process as claimed in claim 29, wherein the thermoplastic material has a softening point above the usual service temperature of the surface.

31. The process as claimed in claim 29, wherein the thermoplastic material has a softening point above about 100° C.

32. The process as claimed in claim 29, wherein the thermoplastic material is fluid in a temperature range of about 150° C. to about 250° C.

33. The process as claimed in claim 29, wherein the thermoplastic material is fluid in a temperature range of about 180° C. to about 230° C.

34. The process as claimed in claim 29, wherein the thermoplastic material has an affinity for adhesive.

35. The process as claimed in claim 28, wherein the coating material is a thermoplastic material selected from the group consisting of ethylene/vinyl acetate copolymers, polyamides, polyesters, polyolefins, thermoplastic polyurethanes and mixtures thereof.

36. The process as claimed in claim 35, wherein the polyolefin is substantially atactic poly-α-olefin.

37. The process as claimed in claim 28, wherein the coating material is a crosslinkable thermoplastic.

38. The process as claimed in claim 37, wherein the coating material is a cross-linkable thermoplastic selected from the group consisting of a moisture-crosslinking isocyanate-terminated polyurethane prepolymer, a two-component system based on epoxylamine, a UV-crosslinking system based on acrylate wherein the reactive thermoplastic crosslinks to form a thermoset, a UV-crosslinking system based on methacrylate wherein the reactive thermoplastic crosslinks to form a thermoset, a UV-crosslinking system based on unsaturated polyester wherein the reactive thermoplastic crosslinks to form a thermoset and mixtures thereof.

39. The process as claimed in claim 37, wherein the coating material is a croslinkable polyurethane-based hot-melt adhesive, wherein said thermoplastic first sets after cooling and is then chemically crosslinked to form a thermoset.

40. The process as claimed in claim 28, wherein the coating material is a mineral surfacing compound.

41. The process as claimed in claim 28, further comprising the step of heating the coating material, wherein said heating occurs during the application of the coating material to the surface.

42. The process as claimed in claim 28, further comprising the step of heating the coating material, wherein said heating occurs after the application of the coating material to the edge surface.

43. A coated edge surface produced by the process of claim 28.

44. An apparatus for treating an edge surface comprising a narrow surface between two non-intersecting surfaces of a wooden substrate to produce a smoothed, textured or embossed coating thereon comprising:

an applying means for applying a continuous layer of a formable coating material having a variable thickness across a width of the layer onto a transfer means the layer conforming to a length of the edge;

a means for transferring the continuous layer of the formable coating material to the edge surface of the substrate to produce a coated edge surface, wherein said transfer means comprises a transfer belt, whereby said transfer belt takes up the layer of coating material from the applying means located adjacent to the transfer means, and transfers it to said edge surface; and a means for smoothing the layer of coating material on said coated edge surface arranged to contact the coated edge surface.

45. The apparatus as claimed in claim 44, wherein the transfer belt is an endless transfer belt.

46. The apparatus as claimed in claim 44, wherein the means for smoothing comprises a belts.

47. The apparatus as claimed in claim 44, wherein the means for smoothing comprises a slide block.

48. The apparatus as claimed in claim 46, wherein the transfer bell is also said mains for smoothing.

49. The apparatus as claimed in claim 44, further comprising a means for applying pressure to the transfer belt.

50. The apparatus as claimed in claim 44, further comprising a press on element arranged opposite the means for applying the coating material to the transfer belt.

51. The apparatus as claimed in claim 50, wherein the means for applying comprises a means for producing a continuous variable thickness profile of coating material in a direction of a width of the transfer belt.

52. The apparatus as claimed in claim 51, wherein the means for producing a variable thickness profile comprises at least one application roller, wherein said application roller has depressions in its surface.

53. The apparatus as claimed in claim 51, wherein the means for producing a variable thickness profile is at least one application nozzle, wherein said application nozzle is widened at locations along the nozzle slit.

54. The apparatus as claimed in claim 44, wherein the means for applying the coating material comprises at least one application nozzle with at least one nozzle slit, whereby said application nozzle applies the coating material to the transfer belt.

55. The apparatus as claimed in claim 44, further comprising a means for applying pressure to the transfer belt, whereby said means for applying pressure applies pressure to the transfer belt thereby transferring the coating material to the edge surface.

56. The apparatus as claimed in claim 55, wherein the means for applying pressure comprises a fixing roller.

57. The apparatus as claimed in claim 55, wherein the means for applying pressure comprises slide blocks.

58. The apparatus as claimed in claim 55, wherein the means for applying pressure comprises pressure pads.

59. An apparatus of claim 44, for treating an edge surface of a substrate, wherein said applying means comprises at least one application nozzle whereby said at least one application nozzle applies the coating material to the transfer means to transfer the coating material to said edge surface.

60. The apparatus as claimed in claim 59, wherein the means for smoothing comprises a belt.

61. The apparatus as claimed in claim 59, wherein the means for smoothing comprises a slide block.

62. An apparatus of claim 44, wherein said means for applying comprises at least one application roller, whereby said at least one application roller takes up the coating material and applies it to a surface of a transfer belt for application to the edge surface; and a means for smoothing said coated surface.

63. The apparatus as claimed in claim 62, wherein the means for smoothing comprises a belt.

64. The apparatus as claimed in claim 62, wherein the means for smoothing comprises a slide block.

* * * * *